United States Patent [19]

Helms

[11] 4,331,256

[45] May 25, 1982

[54] LID DISPENSING ARRANGEMENT

[75] Inventor: Charles R. Helms, Malvern, Pa.

[73] Assignee: Container Corporation of America, Chicago, Ill.

[21] Appl. No.: 248,273

[22] Filed: Mar. 27, 1981

[51] Int. Cl.[3] ..... B65D 17/30

[52] U.S. Cl. ..... 220/267; 220/269; 220/270

[58] Field of Search ..... 220/260, 267, 269, 270, 220/277; 229/43 R, 7 R; 222/541, 83

[56] References Cited

U.S. PATENT DOCUMENTS

| | | | |
|---|---|---|---|
| 3,371,818 | 3/1968 | Bozek | 220/267 |
| 4,059,201 | 11/1977 | Foster | 220/267 X |
| 4,211,336 | 7/1980 | Helms | 220/260 X |

*Primary Examiner*—George T. Hall

*Attorney, Agent, or Firm*—Richard W. Carpenter; Davis Chin

[57] ABSTRACT

A dispensing arrangement for a composite plastic and paperboard lid which includes a pivotal tab for forcing a portion of the paperboard away from the plastic rim to provide a dispensing opening.

8 Claims, 4 Drawing Figures

LID DISPENSING ARRANGEMENT

BACKGROUND OF THE INVENTION

1. Field Of The Invention

This invention relates generally to composite plastic and paperboard lids and, more particularly, to a dispensing opening for same.

2. Description Of The Prior Art

A state of the art search directed to the subject matter of this application uncovered the following patents: U.S. Pat. Nos. Re. 27,611; 496,209; 3,159,303; 3,159,304; 3,163,317; 3,187,930; 3,200,985; 3,239,112; 3,251,503; 3,257,022; 3,281,007; 3,282,477; 3,300,081; 3,314,569; 3,335,899; 3,407,957; 3,415,404; 3,415,412; 3,419,181; 3,434,620; 3,458,080; 3,459,315; 3,499,572; 3,532,248; 3,624,789; 3,661,306; 3,836,039; 3,927,795; 3,981,412; 4,087,018; Austrian Pat. No. 277860; Swiss Pat. Nos. 453117; and 463986.

None of the prior art patents uncovered in the search disclosed a composite plastic and paperboard lid having a pivoted tab for separating a portion of the paperboard from the plastic to form a dispensing opening.

SUMMARY OF THE INVENTION

It is an object of the invention to provide a dispensing arrangement for a composite plastic and paperboard lid of a container.

A more specific object of the invention is to provide, in a composite lid having a plastic rim and a paperboard central panel bonded thereto, a tab which may be used to force a portion of the central panel away from the rim to create a dispensing opening therebetween.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 4:
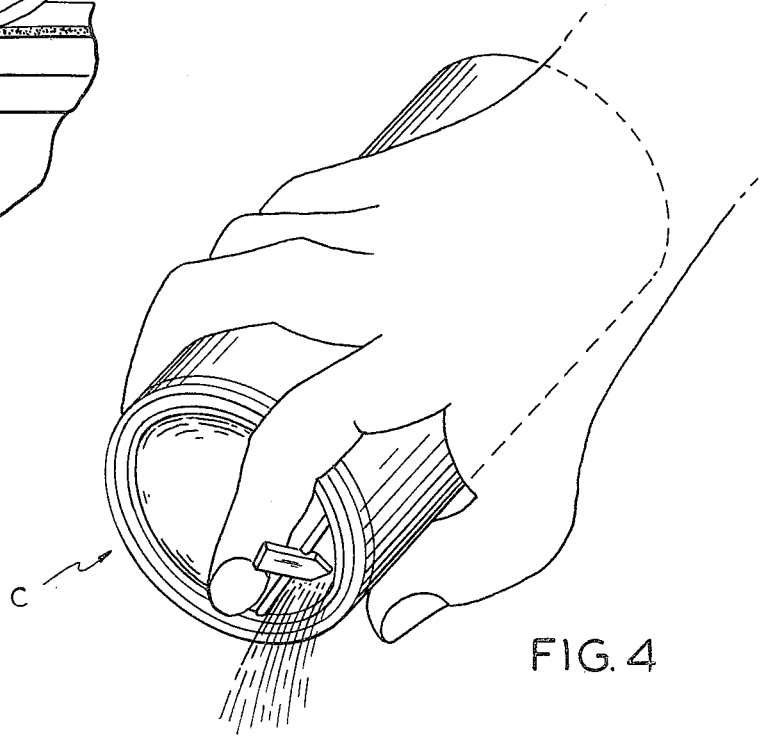
FIG. 4 is a perspective view illustrating the manner in which the container and dispensing feature are employed.

Referring now to the drawings for a better understanding of the invention, it will be seen that the container, indicated generally at C in FIG. 4, is a composite can or carton which includes a tubular body wall B to which is attached a composite plastic and paperboard lid indicated generally at L.

The lid is of the general type and construction disclosed in U.S. Pat No. 3,397,814. In this type of construction the paperboard portion of the lid is inserted into a mold and then plastic is inserted to form the rim of the lid and at the same time bond the rim of the lid to a marginal surface of the paperboard panel insert. Also, if desired the plastic rim of the lid may also be joined to the body wall of the container in the same manner.

Figure 1:
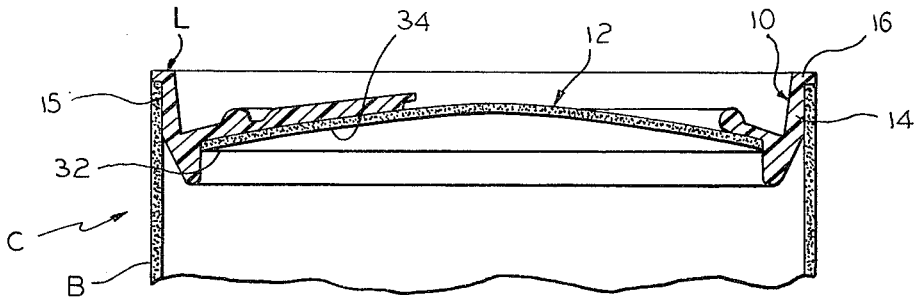
FIG. 1 is a fragmentary transverse vertical section of a container and lid embodying features of the invention.
Figure 2:
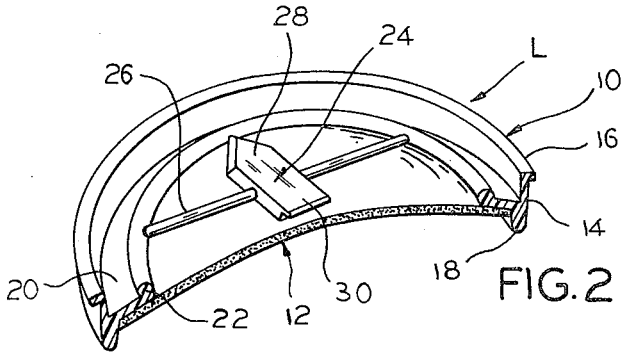
FIG. 2 is a fragmentary perspective view of a portion of the structure illustrated in FIG. 1.
Figure 3:
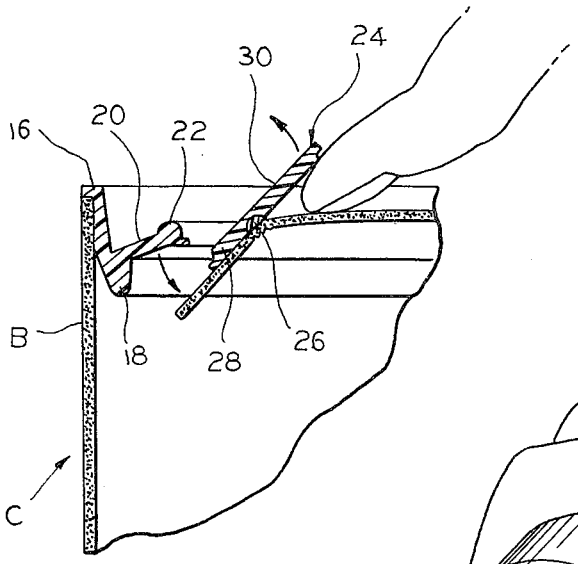
FIG. 3 is a view similar to FIG. 1 but showing the manner in which the invention is employed to provide a dispensing opening in the container lid.

Referring now to FIGS. 1 and 3, it will be seen that the lid L includes an annular molded plastic rim 10 and a relatively thin round central panel 12 formed of paperboard and having its marginal portion secured to the rim 10 in a manner previously described.

Rim 10 includes a generally vertically disposed skirt or outer side flange 14 having at its upper or outer edge a radially outwardly extending shoulder or lip 16 which forms with the main portion of flange 14 a channel or recess 15 adapted to receive an end portion of container body wall B.

Rim 10 includes a downwardly extending lower section 18 formed integrally with the side flange 14 and also includes a radially inwardly extending generally horizontally disposed annular inner end flange 20 having a reinforcing bead 22 formed integrally with its inner edge.

In order to provide a dispensing opening for lid L there is provided an opener tab indicated generally at 24 which is also formed of plastic and is formed integrally with the rim at the same time the rim is formed.

Tab 24 is mounted on a torsion bar 26 which extends across the top of the container from one portion of bead 22 to another portion of the bead. Tab 24 includes a nose portion 28 at the front end thereof and a handle portion 38 at the rear end thereof.

It will be noted that the area between the forward end of nose portion 28 and bead 22 of end flange 20 is provided with an annular recess 29 so that the very tip **28*a*** of the nose portion is relatively narrow and thin.

In order to facilitate separation of a portion of the paperboard central panel 12 from the plastic rim 10 a certain area near the tab 24 may be provided with a release coating such as varnish 32. Also another portion of the central panel lying under the handle portion 30 of the tab may be provided with a release coating 34. In this way it is easier to lift the rear end of the handle from the paperboard panel. As this is done the front end of the tab is depressed and causes the adajacent portion of the central panel 12 to be depressed and forced away from rim end flange 20 to create an opening for dispensing material from the container, as shown in FIG. 4.

I claim:

1. A dispensing arrangement for a composite plastic and paperboard lid, comprising:

(a) an annular molded plastic rim including an outer, side flange, adapted for attachment to a wall of a container body, and an integral, inner, end flange extending radially inward therefrom;

(b) a relatively thin paperboard central panel having a marginal portion of its upper surface bonded to a lower surface of said rim end flange;

(c) said rim including an integral tab pivotally mounted with respect thereto and having one end engageable with a portion of said central panel whereby when the other end of said tab is lifted said one end will be depressed and will force a portion of said central panel away from said rim end flange to provide a dispensing opening in said lid.

2. A dispensing arrangement for a composite plastic and paperboard lid, comprising:

(a) an annular molded plastic rim including an outer, side flange, adapted for attachment to a wall of a container body, and an integral, inner, end flange extending radially inward therefrom;

(b) a relatively thin paperboard central panel having a marginal portion of its upper surface bonded to a lower surface of said rim end flange;

(c) said rim including an integral tab movably engageable with a portion of said central panel and operable to force a portion of said central panel away from said rim end flange to provide a dispensing opening in said lid.

3. A dispensing arrangement according to claim 2, wherein said tab is pivotally mounted with respect to said rim whereby when one end of said tab is lifted the other end will depress a portion of said central panel to force it away from said rim.

4. A dispensing arrangement according to claim 2, wherein said tab is mounted on a bar which extends between different points of said rim inner flange.

5. A dispensing arrangement according to claim 2, wherein said rim outer side flange is molded to said container side wall.

6. A dispensing arrangement according to claim 2, wherein said rim inner end flange is molded to said central panel.

7. A dispensing arrangement according to claim 2, wherein a section of said central panel marginal portion is coated with a release agent to facilitate its detachment from said rim end flange.

8. A dispensing arrangement for a composite plastic and paperboard lid, comprising:

(a) an annular molded plastic rim including an outer, side flange, adapted for attachment to a wall of a container body, and an integral, inner, end flange extending radially inward therefrom;

(b) a relatively thin paperboard central panel having a marginal portion bonded to a surface of said rim end flange;

(c) said rim including an integral tab mounted for engagement with a portion of said central panel whereby upon the application of pressure to the other end of said tab, said one end will force at least a portion of said central panel to become detached from said rim end flange to provide a dispensing opening in said lid.

* * * * *